US011293633B2

(12) United States Patent
Li et al.

(10) Patent No.: US 11,293,633 B2
(45) Date of Patent: Apr. 5, 2022

(54) LAMP HOLDER ASSEMBLY AND LAMP DEVICE THEREOF

(71) Applicants: Shanghai Sansi Electronic Engineering Co., Ltd., Shanghai (CN); Shanghai Sansi Technology Co., Ltd., Shanghai (CN); Jiashan Sansi Optoelectronic Technology Co., Ltd., Zhejiang (CN); Pujiang Sansi Optoelectronic Technology Co. Ltd., Zhejiang (CN)

(72) Inventors: Shan Li, Shanghai (CN); Ming Chen, Shanghai (CN); Xiaoliang He, Shanghai (CN); Shuyang Fu, Shanghai (CN)

(73) Assignees: Shanghai Sansi Electronic Engineering Co., Ltd., Shanghai (CN); Shanghai Sansi Technology Co., Ltd., Shanghai (CN); Jiashan Sansi Optoelectronic Technology Co., Ltd., Zhejiang (CN); Pujiang Sansi Optoelectronic Technology Co. Ltd., Zhejiang (CN)

( * ) Notice: Subject to any disclaimer, the term of this patent is extended or adjusted under 35 U.S.C. 154(b) by 0 days.

(21) Appl. No.: 16/984,175

(22) Filed: Aug. 4, 2020

(65) Prior Publication Data

US 2020/0363052 A1 Nov. 19, 2020

(30) Foreign Application Priority Data

Nov. 13, 2019 (CN) ..... 201911107465.6
Nov. 13, 2019 (CN) ..... 201921962713.0

(51) Int. Cl.
*F21V 29/77* (2015.01)
*F21V 17/16* (2006.01)
(Continued)

(52) U.S. Cl.
CPC ..... *F21V 29/773* (2015.01); *F21V 17/164* (2013.01); *F21Y 2107/00* (2016.08); *F21Y 2115/10* (2016.08)

(58) Field of Classification Search
CPC .... F21V 29/773; F21V 17/164; F21V 17/005; F21V 29/503; F21V 29/70; F21V 5/08;
(Continued)

(56) References Cited

U.S. PATENT DOCUMENTS 5,567,036 A * 10/1996 Theobald ..... B60Q 1/2696 362/485
7,237,936 B1 * 7/2007 Gibson ..... F21S 45/33 362/547
(Continued)

*Primary Examiner* — Peggy A Neils

(57) ABSTRACT

The present disclosure provides a lamp holder assembly and lamp device thereof, including a lamp body, which includes a housing, a heat radiator, a plurality of light-emitting devices, and a lens. The heat radiator is placed in a receiving cavity of the housing. The heat radiator includes a platform for attaching each of the light-emitting devices. The lens covers an opening at one end of the housing to fix the heat radiator. At least one top surface of a platform facing the light exiting direction has a certain slope relative to the horizontal direction perpendicular to the light exiting direction. The lens includes a light exiting surface opposite to the top surface of each platform. The lamp holder assembly has a small structure, high space utilization, large irradiation area, and uniform illumination. The light is emitted in a direct manner, which minimizes light loss and improves light emitting efficiency.

11 Claims, 3 Drawing Sheets

(51) Int. Cl.
*F21Y 107/00* (2016.01)
*F21Y 115/10* (2016.01)

(58) Field of Classification Search
CPC .... F21V 9/50; F21Y 2107/00; F21Y 2115/10; F21Y 2107/50; F21S 8/035
See application file for complete search history.

(56) References Cited

U.S. PATENT DOCUMENTS

| | | | | |
|---|---|---|---|---|
| 7,621,667 | B2 * | 11/2009 | Behr | F21K 9/20 362/651 |
| 8,830,082 | B2 * | 9/2014 | Ku | G08B 5/36 340/815.45 |
| 9,546,782 | B2 * | 1/2017 | Mitchell | F21V 23/009 |
| 9,657,934 | B2 * | 5/2017 | Xiong | F21V 23/006 |
| 2018/0003365 | A1 * | 1/2018 | Nanni | F21V 17/14 |
| 2019/0242552 | A1 * | 8/2019 | Liu | F21V 7/0091 |

* cited by examiner

LAMP HOLDER ASSEMBLY AND LAMP DEVICE THEREOF

CROSS REFERENCE TO RELATED APPLICATION

This application claims the benefits of priorities to Chinese Patent Application No. CN 2019111074656, entitled "LAMP HOLDER ASSEMBLY AND LAMP DEVICE THEREOF", filed with CNIPA on Nov. 13, 2019, and Chinese Patent Application No. CN 2019219627130, entitled "LAMP HOLDER ASSEMBLY AND LAMP DEVICE THEREOF", filed with CNIPA on Nov. 13, 2019, the contents of which are incorporated herein by reference in their entireties.

BACKGROUND

Field of Disclosure

The present disclosure relates to the field of lamp holder, in particular, to a lamp holder assembly and lamp device thereof.

Description of Related Arts

The structure of the light emitting part of the traditional table lamp holder or gallery lamp holder is generally straight-emitting or side-emitting. The adjustment of the light angle depends on reflection, refraction and scattering, resulting in great loss of luminous efficiency. Moreover, such a lamp holder tends to form glare when emitting light, and not all points on the light spot formed by the irradiation are uniform in brightness. The brightness near the lamp holder is high, while the brightness away from the lamp holder is low. In addition, the current lamp holders are always designed to be large to achieve large-area irradiation and uniformity.

SUMMARY

The present disclosure provides a lamp holder assembly and lamp device thereof, to solve at least one problem in the traditional technology.

The present disclosure provides a lamp holder assembly, including a housing, a heat radiator, a plurality of light-emitting devices, and a lens. The heat radiator is placed in a receiving cavity of the housing. The heat radiator includes a platform for attaching each of the light-emitting devices. The lens covers an opening at one end of the housing to fix the heat radiator. At least one top surface of a platform facing the light exiting direction has a certain slope relative to the horizontal direction perpendicular to the light exiting direction. The lens includes a light exiting surface opposite to the top surface of each platform.

In an embodiment of the present disclosure, the housing is a cylinder; one end of the housing includes an opening. The housing is reserved with a receiving cavity for placing the heat radiator.

In an embodiment of the present disclosure, the inner side surface of the housing includes a plurality of blocking bars to fix the heat radiator by snap-fitting; and/or, the inner side surface of the housing includes a plurality of main snap-fit posts to snap-fit the lens.

In an embodiment of the present disclosure, the outer side surface of the heat radiator is equidistantly provided with a plurality of heat radiation fences. The space between two adjacent heat radiation fences is used for fixing the plurality of blocking bars on the inner side surface of the housing by snap-fitting, and/or for passing through the plurality of main snap-fit posts on the inner side surface of the housing to snap-fit the lens.

In an embodiment of the present disclosure, the side of the lens includes an auxiliary snap-fit post which faces the backlight direction and is adapted to be snap-fitted with the plurality of main snap-fit posts on the inner side surface of the housing.

In an embodiment of the present disclosure, the heat radiator is a cylinder; one end of the heat radiator includes an opening. A plurality of the platforms and a plurality of heat radiation through holes protrude from the heat radiator.

In an embodiment of the present disclosure, the lens has a heat radiation hole corresponding to each heat radiation through hole.

In an embodiment of the present disclosure, the light exiting surface is parallel to the top surface of the opposite platform.

In an embodiment of the present disclosure, the side surface of the housing includes a first wire opening, and the side surface of the heat radiator includes a second wire opening corresponding to the position of the first wiring opening for connecting the power supply wiring.

In an embodiment of the present disclosure, the heat radiator is made of aluminum substrate material.

In an embodiment of the present disclosure, the light-emitting device is composed of a ceramic base and an LED chip.

The present disclosure provides a lamp device, including a lamp holder assembly as described above.

The present disclosure provides a lamp holder assembly and lamp device thereof, including a lamp body, which includes a housing, a heat radiator, a plurality of light-emitting devices, and a lens. The heat radiator is placed in a receiving cavity of the housing. The heat radiator includes a platform for attaching each of the light-emitting devices. The lens covers an opening at one end of the housing to fix the heat radiator. At least one top surface of a platform facing the light exiting direction has a certain slope relative to the horizontal direction perpendicular to the light exiting direction. The lens includes a light exiting surface opposite to the top surface of each platform. The lamp holder assembly of the present disclosure has high space utilization, large irradiation area, and uniform illumination. The brightness of all points on the light spots formed by the illumination is uniform. The light is emitted in a direct manner, which minimizes light loss and improves light emitting efficiency.

DETAILED DESCRIPTION OF THE PREFERRED EMBODIMENTS

Figure 1:
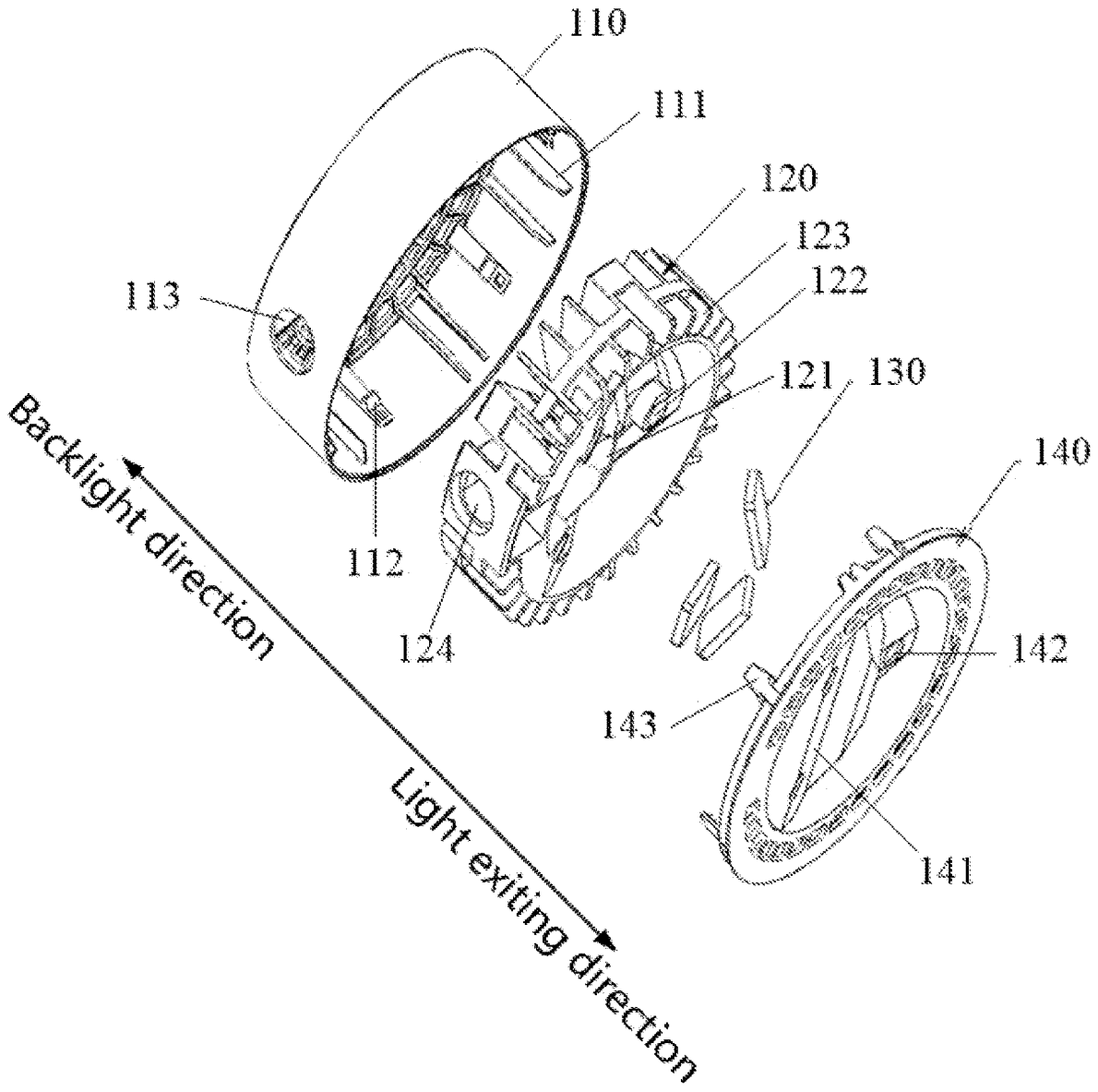
FIG. 1 is an exploded view of a lamp holder assembly according to an embodiment of the present disclosure.

The embodiments of the present disclosure will be described below through exemplary embodiments. Those skilled in the art can easily understand other advantages and effects of the present disclosure according to contents disclosed by the specification. The present disclosure can also be implemented or applied through other different exemplary embodiments. Various modifications or changes can also be made to all details in the specification based on different points of view and applications without departing from the spirit of the present disclosure. It needs to be stated that the embodiments and the features in the embodiments in the present disclosure can be combined with one another under the situation of no conflict.

The embodiments of the present disclosure are described in detail below with reference to the drawings, so that those skilled in the art can easily implement the present disclosure. The present disclosure can be embodied in a variety of different forms and is not limited to the embodiments described herein.

In order to clarify the present disclosure, components that are not related to the description are omitted, and the same or similar components are denoted by the same reference numerals throughout the specification.

Throughout the specification, when a component is "connected" with another component, this includes not only the "direct connection" but also the "indirect connection" in which other elements are placed therebetween. In addition, when a certain component "includes" a certain element, unless otherwise stated, other elements are not excluded, which means other elements may be included.

When a component is referred to as being "above" another component, it may be directly above the other component; however, other components may also be accompanied between the two components. In contrast, when a component is referred to as being "directly above" another component, there are no other components between the two components.

Although the terms first, second, etc. are used herein to describe various elements in some embodiments, these elements should not be limited by these terms. These terms are only used to distinguish one element from another. For example, the first interface and the second interface. In addition, as used herein, the singular forms "a", "an" and "the" are intended to include the plural forms as well, unless the context clearly indicates otherwise. It should be further understood that the terms "comprise", "include" indicate that there are the described features, steps, operations, elements, components, items, categories, and/or groups, but the existence, appearance, or addition of one or more other features, steps, operations, elements, components, items, categories, and/or groups are not excluded. The terms or and "and/or" are used herein to be interpreted as inclusive or meaning any one or any combination. Thus, "A, B or C" or "A, B and/or C" means "any one of the following: A; B; C; A and B; A and C; B and C; A, B and C". An exception to this definition occurs only when a combination of elements, functions, steps or operations are inherently mutually exclusive in some manner.

The terminology used herein is only for the purpose of the description of special embodiments, and is not intended to limit the present disclosure. The singular form as used herein includes plural forms as long as the statement does not explicitly indicate the opposite. The word "include" used in the specification means the materialization of the specific features, regions, integers, steps, operations, elements and/or components, and does not exclude the existence or addition of other features, regions, integers, steps, operations, elements and/or components.

Terms referring to relative spaces such as "below", "above", etc. may be used to more easily illustrate the relationship of one component to another component illustrated in the drawings. Such terms refer to not only the meanings indicated in the drawings, but also other meanings or operations of the device in use. For example, a component that is described as "below" other components is described as "above" other components if the device in the drawings is turned over. Therefore, the term "below" is used to include all of the above and under. The device can be rotated by 90° or other angles, and terms representing relative space are also explained accordingly.

The structure of the light emitting part of the traditional table lamp holder or gallery lamp holder is generally straight-emitting or side-emitting. The adjustment of the light angle depends on reflection, refraction and scattering, resulting in great loss of luminous efficiency. Moreover, such a lamp holder tends to form glare when emitting light, and not all points on the light spot formed by the irradiation are uniform in brightness. The brightness near the lamp holder is high, while the brightness away from the lamp holder is low. In addition, the current lamp holders are always designed to be large to achieve large-area irradiation and uniformity. The present disclosure provides a lamp holder assembly and table lamp thereof, to solve at least one of the above-mentioned problems.

It needs to be stated that the lamp holder assembly described in the present disclosure may be used in various lamp bodies or lamp scenarios such as table lamps, gallery lamps, shop window lamps, cabinet lamps and the like. Preferably, the lamp holder assembly described in the present disclosure is applicable for a table lamp.

FIG. 1 shows an overall schematic diagram of a lamp holder assembly according to an embodiment of the present disclosure. As shown, the lamp holder assembly includes a housing 110, a heat radiator 120, a plurality of light-emitting devices 130, and a lens 140.

Generally speaking, the heat radiator 120 is placed in a receiving cavity of the housing 110. The heat radiator 120 includes a platform 121 for attaching each of the light-emitting devices 130. The lens covers an opening at one end of the housing 110 to fix the heat radiator 120.

The light emitting angle of the traditional lamp holder component is adjusted mostly depends on reflection, refraction and scattering, which leads to a large loss of luminous efficiency. To solve this problem, the present disclosure divides the light emitting component into multiple parts to adjust the angle of the light emitter, so as to meet the illumination requirement.

In an embodiment, the housing 110 is a cylinder. One end of the housing 110 is provided with an opening. The housing 110 is reserved with a receiving cavity for placing the heat radiator 120.

To facilitate installation, the housing 110 of the present disclosure is preferably a cylinder. However, it should be understood that the housing 110 of the present disclosure may also be a polygonal prism, such as a cube, a hexagonal prism, an octagonal prism, etc. Of course, those polygonal prisms may still be used for a heat radiator 120 fixed as a cylinder. That is, as long as the center of the heat radiator 120 is aligned with that of the housing 110, the sides of the heat radiator 120 can be in contact with at least four sides of the housing 110 to achieve the fixation of the two. In addition, when the housing 110 is a polygonal prism, the lens 140 is a polygon corresponding to the polygonal prism.

In one or more implementable embodiments, the housing 110 is made of plastic for consideration of weight, heat radiation and cost.

It should be noted that at least one top surface of a platform 121 facing the light exiting direction (not shown in FIG. 1) has a certain slope relative to the horizontal direction perpendicular to the light exiting direction. The lens 140 includes a light exiting surface opposite to the top surface of each platform.

Figure 2:
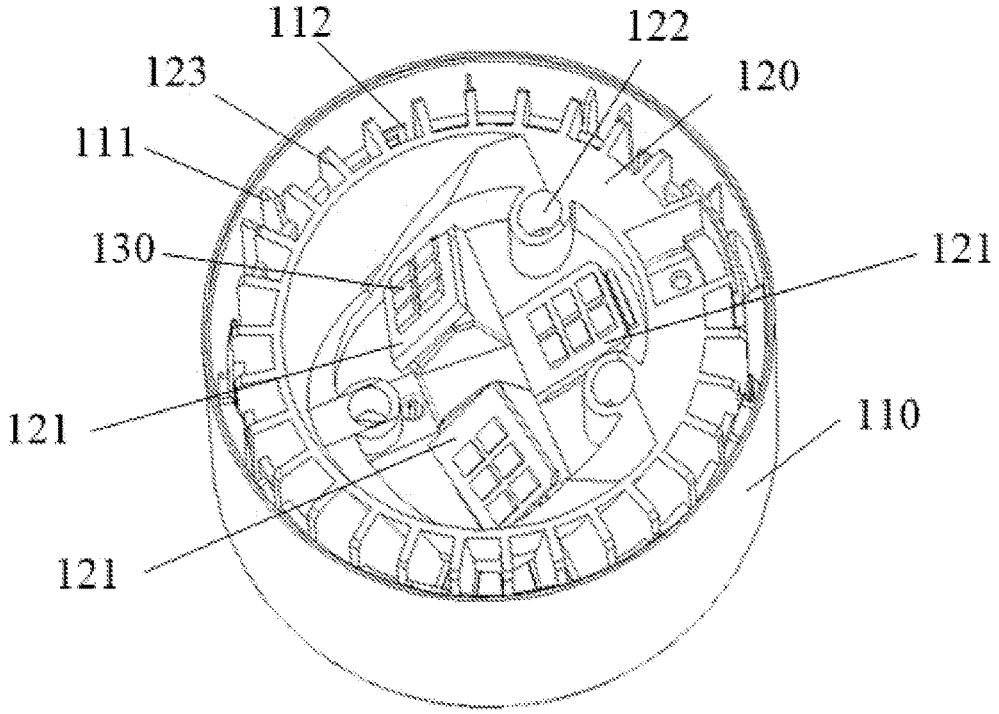
FIG. 2 is a partial schematic diagram of a lamp holder assembly according to an embodiment of the present disclosure.
Figure 3A:
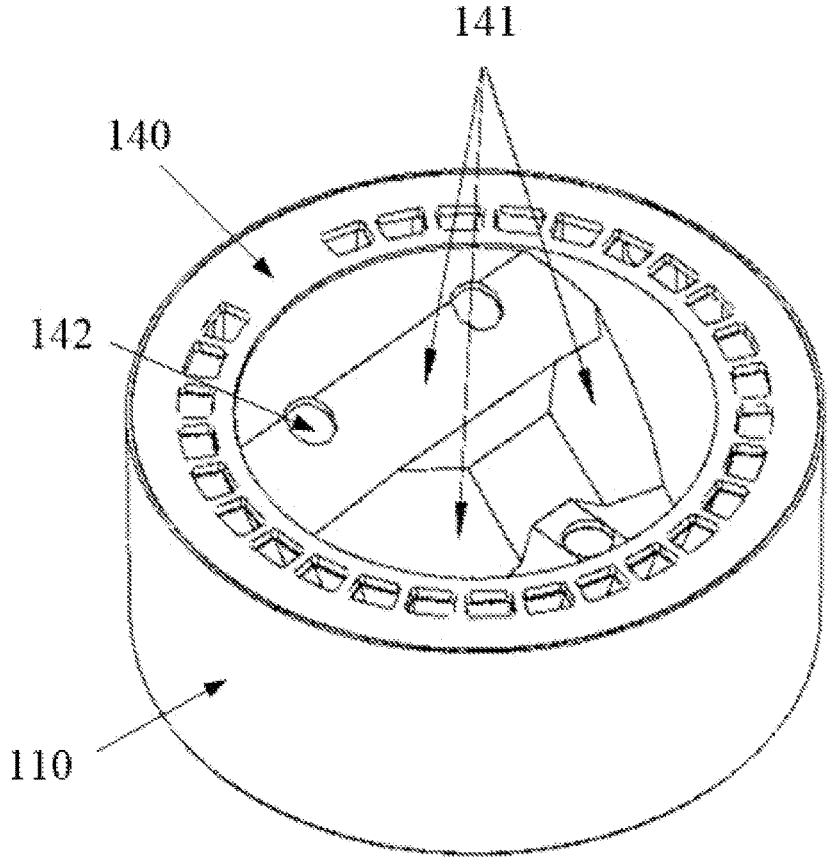
FIG. 3A shows a schematic front view of a lens according to an embodiment of the present disclosure.
Figure 3B:
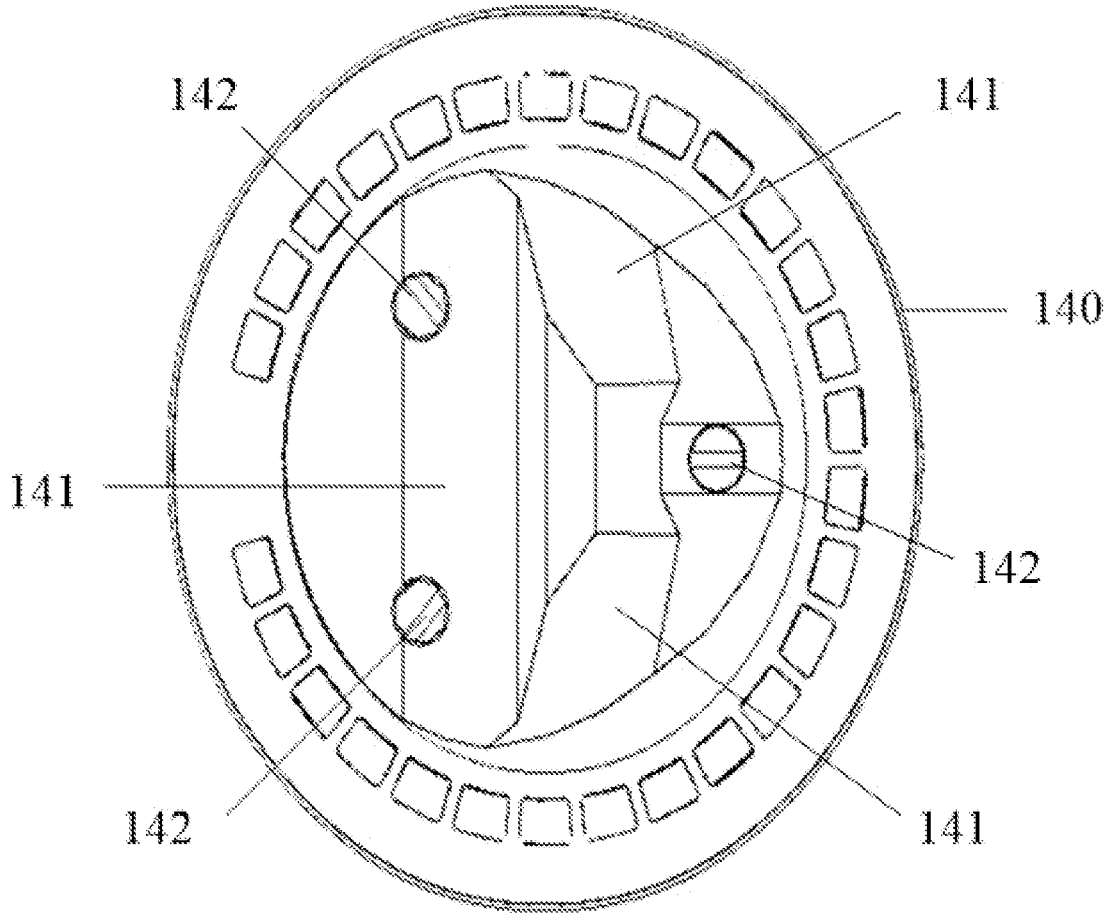
FIG. 3B is a schematic top view of a lens according to an embodiment of the present disclosure.
Figure 4:
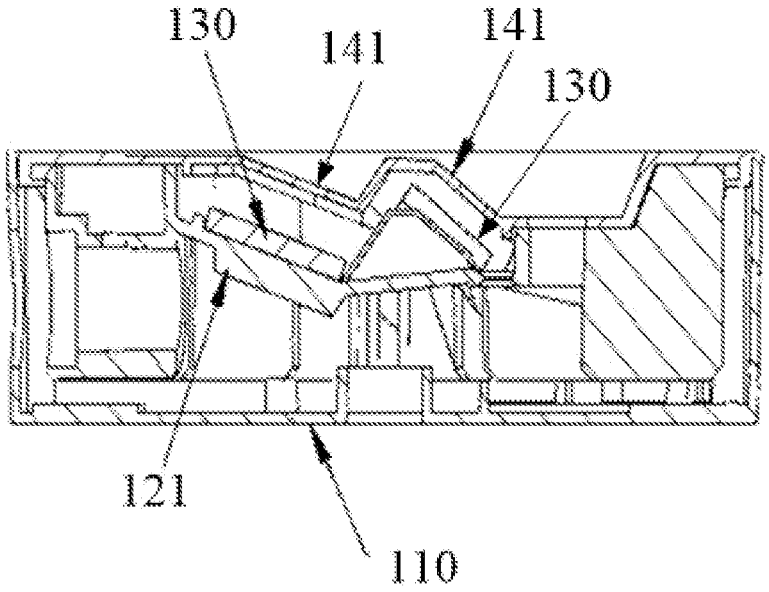
FIG. 4 is a schematic top view of a lamp holder assembly according to an embodiment of the present disclosure.

For the detailed internal structure of the housing 110, the heat radiator 120, the light-emitting device 130 in the lamp holder assembly, refer to FIG. 2. In addition, reference may also be made to FIGS. 3A and 3B for the schematic diagrams of the lens 140 from the normal viewing angle and the top viewing angle, and to FIG. 4 for the side view of the lamp holder assembly.

As shown in FIG. 1 or FIG. 2, the platform 121 and the light-emitting device 130 attached thereto are shown as only three in the present disclosure. However, in other implementable embodiments, they may also be two or more than three.

For example, assuming that the number of the platforms 121 is two, the top surface of one of the platforms 121 may have a certain slope, and the top surface of the other platform 121 does not have a slope relative to the horizontal direction. Alternatively, both of the top surfaces of the two platforms 121 have a certain slope, and the orientation of the top surface of each platform 121 may be set to be the same or different according to actual conditions.

When the number of the platform 121 is three or more, the number of the platform 121 with a top surface having a certain slope may be one, two, and three. In addition, when the number of the platform 121 with a top surface having a certain slope is two or three, the orientation of the top surface of each platform 121 may be set to be the same or different according to actual conditions.

In some implementable embodiments, the setting of the number of the platform 121 with a top surface having a certain slope may be adjusted in the design and production processing stages according to the applied scenario or actual needs, to ensure the maximum light exiting efficiency and irradiation area, so as to enlarge the irradiation area when the size of the lamp holder assembly is limited.

In other implementable embodiments, the slope of the platform 121 may be increased or decreased during the design and production processing stages according to actual needs, so as to adjust the irradiation angle of each light-emitting device 130.

Further, to optimize the light-emitting angle and light-emitting efficiency of each light-emitting device 130 that attached to the platforms 121 in different orientations, the lens 140 is designed as an irregular plane. More specifically, the area corresponding to the top surface of each platform 121 is designed to be parallel to the light exiting surface 141 of the top surface of each platform 121. That is, the light-emitting device 130 is attached to the top surface of the platform 121. Since the light exiting surface 141 is parallel to the top surface of the platform 121, the light exiting surface 141 is also parallel to the attached light emitting device 130. Therefore, the maximum luminous efficiency and irradiation area can be ensured to enlarge the irradiation area when the size of the lamp holder assembly is limited.

In the present disclosure, a plurality of light emitting devices 130 with different angles are provided, and such setting makes the lamp holder much smaller than the traditional LED table lamp. Emitted lights of different angles lead to uniform illumination, which is unlike the traditional technology, in which the brightness near the lamp holder is high while the brightness away from the lamp holder is low. The present disclosure has multiple different light-emitting devices 130, the brightness of all points on the light spots formed by the illumination of the table lamp is uniform.

In addition, the present application enables the light-emitting device 130 to emit light in a direct manner, minimizing light loss, and improving light emitting efficiency.

In this embodiment, the heat radiator 120 is a cylinder, one end of the heat radiator 120 includes an opening. A plurality of the platforms 121 and a plurality of heat radiation through holes 122 protrude from the heat radiator 120.

Correspondingly, the lens 140 has a heat radiation hole 142 corresponding to each heat radiation through hole 122.

In the present disclosure, the heat radiation through hole 122 corresponds to the heat radiation hole 142, the heat generated by the light-emitting device 130 in the cavity of the heat radiator 120 can be emitted from the lamp holder assembly through the heat radiation through hole 122 and the heat radiation hole 142, to achieve the heat exchange with the outside air and improve the heat radiation performance.

In this embodiment, the inner side surface of the housing 110 includes a plurality of blocking bars 111 to fix the heat radiator 120 by snap-fitting; and/or, the inner side surface of the housing 110 includes a plurality of main snap-fit posts 112 to snap-fit the lens 140.

Correspondingly, the outer side surface of the heat radiator 120 is equidistantly provided with a plurality of heat radiation fence 123. The space between two adjacent heat radiation fences 123 is used for fixing the plurality of blocking bars 111 on the inner side surface of the housing 110 by snap-fitting, and/or for passing through the plurality of main snap-fit posts 112 on the inner side surface of the housing 110 to snap-fit the lens 140.

The blocking bar 111 enables the heat radiator 120 to be quickly aligned when placed in the housing 110, and keeps the relative position of the housing 110 and the heat radiator 120 unchanged.

In this embodiment, the side of the lens 140 includes an auxiliary snap-fit post 143 which faces the backlight direction and is adapted to be snap-fitted with the plurality of main snap-fit posts 112 on the inner side surface of the housing 110.

The main snap-fit post 112 and the auxiliary snap-fit post 143 are a set of snap-fit assembly. The main snap-fit post 112 and the auxiliary snap-fit post 143 both have a protrusion for snap-fitting at the heads thereof, which has certain elasticity. After the head of the main snap-fit post 112 contacts with the head of the auxiliary snap-fit post 143 for a certain distance, the protrusions of the two is snap-fitted with each other. The main snap-fit post 112 and the auxiliary snap-fit post 143 facilitate the installation and removal of the lens 140.

In this embodiment, the heat radiator 120 is made of aluminum substrate material. The aluminum substrate material has good heat radiation capability. In addition, it can be seen from the above that the heat radiator 120 further improves the heat radiation performance through the heat radiation fence 123 and the heat radiation through hole 122.

In this embodiment, the side surface of the housing 110 includes a first wire opening 113. The side surface of the heat radiator 120 includes a second wire opening 124 corresponding to the position of the first wiring opening 113 for connecting the power supply wiring.

Preferably, the first wiring opening 113 and the second wiring opening 124 are aligned. On the one hand, the power supply wiring could be connected, on the other hand, support parts, such as table lamp arms, could be supported.

In this embodiment, the light-emitting device 130 is composed of a ceramic base and an LED chip. The light-emitting device 130 may be connected with an external power source (such as a table lamp main body) through the first wiring opening 113 and the second wiring opening 124.

The lamp holder assembly of the present disclosure has a small structure, high space utilization, large irradiation area, and uniform illumination. The brightness of all points on the light spots formed by the illumination is uniform. The light is emitted in a direct manner, which minimizes light loss and improves light emitting efficiency.

The present disclosure further provides a lamp device, including a lamp holder assembly as described in FIGS. 1-2. In one or more embodiments, the lamp devices described in the present disclosure include, but are not limited to, lamp devices of various forms or functions such as table lamps, gallery lamps, shop window lamps, cabinet lamps and the like.

As mentioned above, the present disclosure effectively overcomes various shortcomings in the traditional technology and has high industrial utilization value.

The above-mentioned embodiments are merely illustrative of the principle and effects of the present disclosure instead of limiting the present disclosure. Modifications or variations of the above-described embodiments may be made by those skilled in the art without departing from the spirit and scope of the present disclosure. Therefore, all equivalent modifications or changes made by those who have common knowledge in the art without departing from the spirit and technical concept disclosed by the present disclosure shall be still covered by the claims of the present disclosure.

What is claimed is:

1. A lamp holder assembly, comprising a housing, a heat radiator, a plurality of light-emitting devices, and a lens; wherein the heat radiator is placed in a receiving cavity of the housing, the heat radiator includes a platform for attaching each of the light-emitting devices, and the lens covers an opening at one end of the housing to fix the heat radiator;

at least one top surface of the platform facing a light exiting direction has a certain slope relative to a horizontal direction perpendicular to the light exiting direction;

the lens includes a light exiting surface opposite to the top surface of each platform;

an inner side surface of the housing includes a plurality of blocking bars to fix the heat radiator by snap-fitting;

an outer side surface of the heat radiator is equidistantly provided with a plurality of heat radiation fences; the space between two adjacent heat radiation fences is used to fix the plurality of blocking bars on the inner side surface of the housing by snap-fitting.

2. The lamp holder assembly according to claim 1, wherein the housing is a cylinder, one end of the housing includes an opening, and the housing is reserved with a receiving cavity for placing the heat radiator.

3. The lamp holder assembly according to claim 1, wherein the heat radiator is a cylinder, one end of the heat radiator includes an opening, and a plurality of the platforms and a plurality of heat radiation through holes in the heat radiator.

4. The lamp holder assembly according to claim 3, wherein the lens has a heat radiation hole corresponding to each heat radiation through hole.

5. The lamp holder assembly according to claim 1, wherein the light exiting surface is parallel to the top surface of the opposite platform.

6. The lamp holder assembly according to claim 1, wherein a side surface of the housing includes a first wire opening, and a side surface of the heat radiator includes a second wire opening corresponding to the position of the first wiring opening for connecting a power supply wiring.

7. The lamp holder assembly according to claim 1, wherein the heat radiator is made of aluminum substrate material.

8. The lamp holder assembly according to claim 1, wherein the light-emitting device consists of a ceramic base and an LED chip.

9. A lamp device, comprising the lamp holder assembly according to claim 1.

10. A lamp holder assembly, comprising a housing, a heat radiator, a plurality of light-emitting devices, and a lens; wherein the heat radiator is placed in a receiving cavity of the housing, the heat radiator includes a platform for attaching each of the light-emitting devices, and the lens covers an opening at one end of the housing to fix the heat radiator;

at least one top surface of the platform facing a light exiting direction has a certain slope relative to a horizontal direction perpendicular to the light exiting direction;

the lens includes a light exiting surface opposite to the top surface of each platform;

the inner side surface of the housing includes a plurality of main snap-fit posts to snap-fit the lens;

an outer side surface of the heat radiator is equidistantly provided with a plurality of heat radiation fences to pass through the plurality of main snap-fit posts on the inner side surface of the housing to snap-fit the lens.

11. The lamp holder assembly according to claim 10, wherein a side of the lens includes an auxiliary snap-fit post which faces a backlight direction and is adapted to be snap-fitted with the plurality of main snap-fit posts on the inner side surface of the housing.

* * * * *